United States Patent [19]

Wagner et al.

[11] Patent Number: 4,486,082

[45] Date of Patent: Dec. 4, 1984

[54] APPARATUS FOR TREATING MATERIALS ISSUING FROM PHOTOCOMPOSING MACHINES

[75] Inventors: Gerald Wagner, Ebenhausen; Dieter Wauer, Taufkirchen, both of Fed. Rep. of Germany

[73] Assignee: Agfa-Gevaert Aktiengesellschaft, Leverkusen, Fed. Rep. of Germany

[21] Appl. No.: 496,449

[22] Filed: May 20, 1983

[30] Foreign Application Priority Data

May 28, 1982 [DE] Fed. Rep. of Germany ..... 3220169

[51] Int. Cl.[3] ..... G03D 3/06

[52] U.S. Cl. ..... 354/6; 354/298; 354/320; 354/324

[58] Field of Search ..... 354/5, 6, 21, 76, 78, 354/83, 89, 298, 319, 320, 321, 322, 324; 355/27

[56] References Cited

U.S. PATENT DOCUMENTS 3,511,160 5/1970 Reusel ..... 354/298
3,559,555 2/1971 Street ..... 354/298
3,699,869 10/1972 Jensen ..... 354/298
3,787,689 1/1974 Fidelman ..... 354/298
4,260,234 4/1981 Burton ..... 354/319

*Primary Examiner*—A. A. Mathews
*Attorney, Agent, or Firm*—Peter K. Kontler

[57] ABSTRACT

An apparatus which controls the operation of metering pumps serving to regenerate the baths in a developing machine for exposed photosensitive material issuing from a photocomposing machine has a computer whose outputs transmit appropriate signals to the metering pumps via amplifiers and whose inputs respectively receive signals from a scanner serving to ascertain the width of photosensitive material in the photocomposing machine and the composition of the emulsion, from a forward-reverse counter which ascertains the total length of photosensitive material admitted into the developing machine per unit of time, and from an integrating circuit which receives signals denoting the amounts of radiation issuing from a cathode ray tube or a laser recorder and impinging upon the photosensitive material. This renders it unnecessary to monitor the condition of the baths and/or the photosensitive material in the developing machine.

13 Claims, 2 Drawing Figures

APPARATUS FOR TREATING MATERIALS ISSUING FROM PHOTOCOMPOSING MACHINES

BACKGROUND OF THE INVENTION

The present invention relates to photocomposing or photosetting machines in general, and more particularly to improvements in combinations of such machines with developing machines for the processing of freshly treated photosensitive material. Still more particularly, the invention relates to improvements in devices for regenerating the developing, fixing, rinsing and/or other fluids which are used in such developing machines.

It is known to replenish and/or recondition (i.e., regenerate) the supplies of various treating agents in a developing machine by resorting to regenerating devices in the form of metering pumps which are operated intermittently or continuously for the purpose of ensuring that the condition or quality of the respective baths remains unchanged or fluctuates within a rather narrow range. As a rule, the agent or agents are regenerated at a rate which is a function of the width of photosensitive material and/or overall length of the material which is admitted into the developing machine per unit of time. The just described mode of regulating regeneration of one or more fluids in the bath or baths of a developing machine as a function of the dimensions (width and/or length of photosensitive material) is satisfactory in many instances, especially if the rate of regeneration of one or more agents is further regulated as a function of certain other characteristics of the photosensitive material (such as the composition of emulsion and/or others). However, even such relatively complex regulation of regeneration of developing, fixing and/or other agents is not entirely satisfactory in connection with the development of photosensitive material which issues from a photocomposing machine. This is due to the fact that the concentration of various agents in the developing bath or baths varies as a function of certain additional parameters, such as the density of photosensitive material which issues from the photocomposing machine.

OBJECTS AND SUMMARY OF THE INVENTION

An object of the invention is to provide a novel and improved apparatus for regenerating treating agents in a developing machine which receives photosensitive material from a photocomposing machine.

Another object of the invention is to provide an apparatus which can ensure highly reliable regeneration of various agents at a rate accurately reflecting the requirements of the developing machine to thus ensure optimum treatment of photosensitive material as it issues from the photocomposing machine.

A further object of the invention is to provide the apparatus with novel and improved means for processing signals which are generated in the photocomposing machine and are indicative of various characteristics of photosensitive material as well as of the treatment to which such material is subjected in the photocomposing machine.

An additional object of the invention is to provide a novel and improved method of regenerating various treating agents in a developing machine which receives photosensitive material directly or indirectly from a photocomposing machine.

A further object of the invention is to provide an apparatus which can accurately detect and account for heretofore disregarded characteristics of photosensitive material in as well as downstream of a photosetting machine.

Still another object of the invention is to provide an apparatus which can be built into or assembled with combinations of existing photosetting and developing machines.

The invention is embodied in an apparatus for processing a web (e.g., a film strip or a strip of photographic paper) of photosensitive material. The apparatus comprises a photocomposing machine having means (e.g., a radiation emitting cathode ray tube for composing information on the photosensitive material and a regulating circuit therefore exposing the photosensitive material, a developing machine which serves to develop the exposed photosensitive material and includes at least one bath containing a supply of fluid which contacts the exposed photosensitive material and whose characteristics change as a result of such contact with photosensitive material so that the fluid requires continuous or intermittent regeneration, a metering pump or other suitable adjustable regenerating means for the fluid of the bath in the developing machine, and means for adjusting the regenerating means as a function of the characteristics of undeveloped photosensitive material and as a function of the operation of the photocomposing machine, preferably exclusively as a function of the aforementioned parameters.

The adjusting means can include means (e.g., an integrating circuit) for monitoring the amounts of radiation which is emitted by the tube and control means (e.g., an amplifier) for adjusting the regnerating means as a function of the amounts of radiation which are detected by the integrating circuit. The latter is designed to generate signals denoting the overall density of exposed photosensitive material.

The regulating circuit can be said to constitute a means for generating signals denoting the intensity of emitted radiation, and the integrating circuit serves to integrate such signals so that the control means can adjust the regenerating means as a function of integrated signals. The adjusting means can further comprise an evaluating device (e.g., a suitable computer) a first input of which receives integrated signals and which has at least one second input as well as an output which latter is connected with the control means. The photocomposing machine preferably further comprises signal generating scanning means for transmitting to the second input or inputs of the evaluating device signals denoting at least one characteristic of photosensitive material in the photocomposing machine (e.g., the rate of introduction of exposed photosensitive material from the photocomposing into the developing machine and/or the dimensions of the photosensitive material). The evaluating device transmits to the control means signals which are a function of signals transmitted to the first and second inputs of the evaluating device.

The regulating means of the exposing means can constitute a circuit which generates signals denoting the amounts of radiation which is emitted by the cathode ray tube or an analogous source, and such signals are then integrated by the monitoring means. The signals which are furnished by the monitoring means are normally analog signals; therefore, the adjusting means preferably further comprises an analog-digital converter circuit which is interposed between the monitoring means (integrating circuit) and the corresponding input of the evaluating device (computer).

In addition to the aforementioned scanning means (e.g., a device which determines the width of the photosensitive material and/or the maker of the photosensitive material and/or the composition of emulsion on the emulsion carrier of the photosensitive material), the photocomposing machine can further comprise means for transporting the photosensitive material forwardly and backwards. Such apparatus preferably further comprises a device (e.g., the combination of a start-stop circuit having an input connected with the regulating means of the exposing means and first and second outputs connected to a reverse drive and a motor of the photocomposing machine, and a forward-reverse counter connected to a third output of the forward-reverse drive) for generating signals which denote the quantity of material that is actually introduced into the developing machine per unit of time. The output of the forward-reverse counter is connected to an input of the evaluating device so that the output of the evaluating device transmits to the control means signals which are a function of signals transmitted by the scanning means, by the forward-reverse counter and by the monitoring means. The start-stop circuit can be further connected with the monitoring means to respectively start and arrest the integrating process when the advancement of photosensitive material from the photocomposing machine is respectively started and interrupted. This enables the evaluating device to cause the control means to transmit to the regenerating means regenerating impulses when the transfer of photosensitive material from the photocomposing machine to the developing machine is interrupted for a predetermined interval of time, e.g., an interval which is sufficiently long to warrant regeneration of the fluid in view of oxidation of such fluid which takes place while the developing machine is idle.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
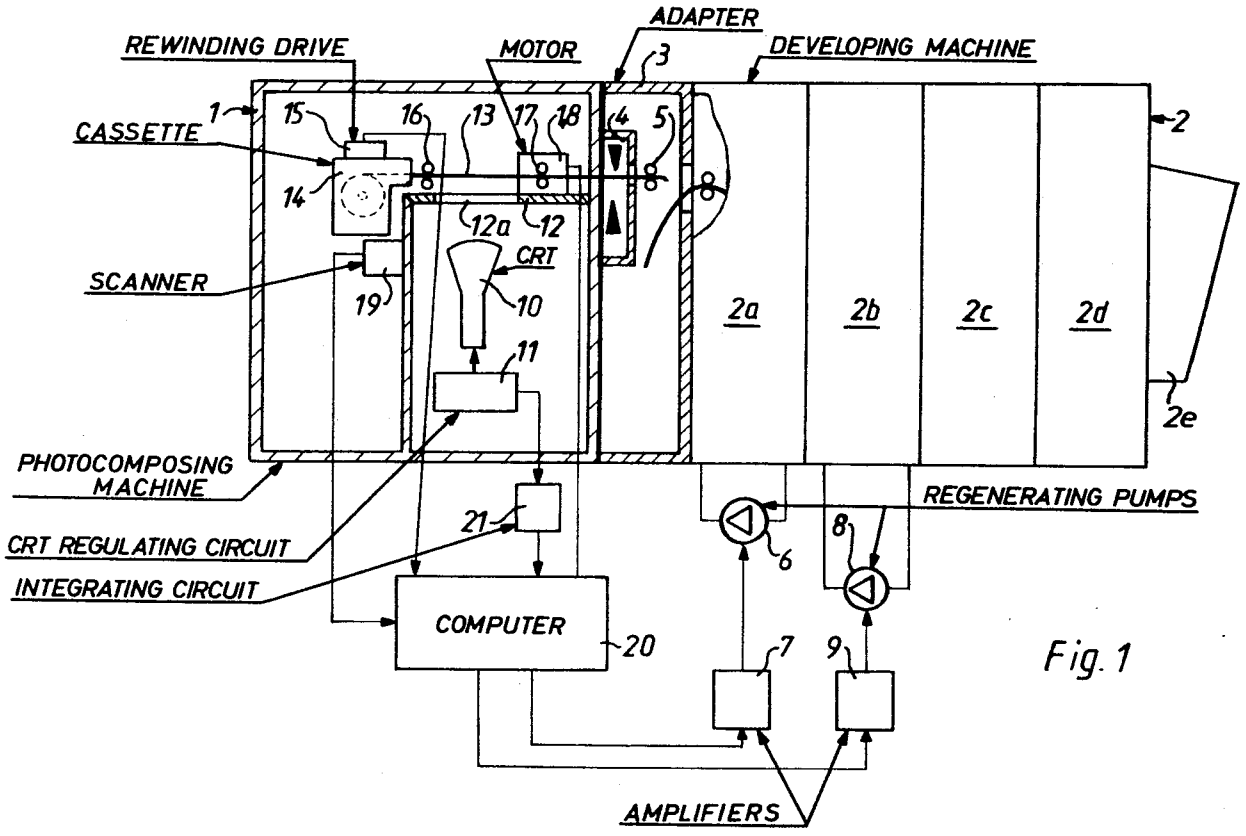
FIG. 1 is a schematic partly elevational and partly sectional view of a photocomposing unit, of a developing machine, and of the devices which regulate the regeneration of fluids in certain sections of the developing machine.

Referring first to FIG. 1, there is shown a photosetting or photocomposing machine 1, a developing machine 2, and an adapter 3 which is interposed between the machines 1 and 2. The adapter 3 comprises or accommodates a severing device 4 for photosensitive material (film or paper) 13 and a pair of advancing rolls 5 at least one of which is or can be driven to advance the material 13 from the interior of the photocomposing machine 1 into the first section 2*a* of the developing machine 2. The purpose of the adapter 3 is to compensate for eventual differences between the speed of transport of photosensitive material 13 in the photocomposing machine 1 and the speed of transport of such material in the developing machine 2. The severing device 4 severs the material 13 in the interior of the adapter 3 at a predetermined location if the machine 1 ceases to supply exposed photosensitive material; this enables the developing machine 2 to advance the material 13 therein at the desired or optimum rate of speed, i.e., to prevent excessive dwell of exposed photosensitive material in the section 2*a* and/or in other section or sections of the developing machine.

The illustrated developing machine 2 includes the aforementioned first section 2*a* which can contain a developing bath, a second section 2*b* which can contain a fixing bath, a third section 2*c* which can contain a supply of washing or rinsing liquid, and a fourth section 2*d* which can contain a circulating body of a heated gaseous fluid (e.g., air) to effect rapid drying of successive increments of the material 13. The fully treated material issues at the outlet 2*e* of the developing machine 2. The contents of the bath in the first section 2*a* can be regenerated by a first metering pump 6 which receives appropriate signals from a suitable control unit 7, and the contents of the fixing bath in the section 2*b* can be regenerated by a second metering pump 8 which receives signals from a second control unit 9. It is clear that the developing machine 2 can be equipped with one or more additional metering pumps (see the pump 8′ and the control unit 9′ of FIG. 2) without departing from the spirit of the invention. Also, only one metering pump can be used if the nature of treatment of photosensitive material does not necessitate regeneration of fluid in more than a single bath. It is further possible to employ more than one metering pump for a particular bath.

The photocomposing machine 1 comprises an exposing unit including a radiation source 10 (such as a cathode ray tube or a laser beam recorder and a signal generating regulating circuit 11 which causes the tube 10 to record information on succesive increments of photosensitive material 13, namely, on the material which is behind a window 12*a* provided in a platform 12 which is installed in the interior of the photosetting machine 1. The photosensitive material 13 is stored in a cassette 14 which is connected to or equipped with a rewinding drive 15. The means for advancing photosensitive material 13 from the cassette 14 toward the adapter 3 comprises two pairs of advancing rolls 16 and 17. At least one of the rolls 17 is driven by a motor 18. The pairs of advancing rolls 16 and 17 are respectively disposed upstream and downstream of the window 12*a*, as considered in the direction of travel of photosensitive material 13 from the cassette 14 toward the adapter 3. The cassette 14 is further connected with a scanner 19 which is a signal transmitting unit capable of reading information which is encoded in or on the material 13 and/or in the cassette 14 and denotes various characteristics of the photosensitive material, such as its width and type. The output of the scanner 19 is connected to one input of a computer 20 which can be said to constitute a signal evaluating device of the means for adjusting the pumps 6 and 8.

The output of the regulating circuit 11 is connected with a second input of the computer 20 by way of a monitoring circuit 21 which also forms part of the means (7, 20, 21) for adjusting the metering pumps 6, 8 and transmits to the computer information denoting the amounts of radiation which is emitted by the tube 10. More accurately stated, the signals which are furnished by the monitoring circuit 21 are indicative of intensity of emitted radiation, and such signals are processed by the computer 20 together with the signals which are supplied by the scanner 19 and with additional signals, namely, those supplied by the motor 18 to denote the speed of the photosensitive material 13 and by the rewinding drive 15.

The two outputs of the computer 20 are connected with the control units 7 and 9 for the respective pumps 6 and 8. Each of the control units 7 and 9 can comprise or constitute an amplifier.

The operation is as follows:

The scanner 19 transmits to the corresponding input of the computer 20 a signal which denotes the width of photosensitive material 13 and the nature of emulsion on the emulsion carrier (paper or cellophane) of such material. The motor 18 (or a device, such as a tachometer generator, which is associated with the motor) transmits signals denoting the speed of photosensitive material 13, i.e., the length of those portions of the web of material 13 which are admitted into the developing machine 2 per unit of time. The computer 20 processes these signals together with the signals which are supplied by the monitoring circuit 21. The signals from the scanner 19 and the motor 18 suffice to enable the computer 20 to calculate the total area of emulsion which is admitted into the developing machine 2 per unit of time as well as the nature of the material 13. This can involve information pertaining to the nature of carrier material (i.e., is the carrier a sheet or strip of paper or a sheet or strip of transparent synthetic plastic material), the manufacturer of the material 13, the optimum developing technique, etc. To this end, the computer 20 stores relevant information which is converted into corresponding output signals for transmission to the control (units) 7 and 9 so that the operation of metering pumps 6 and 8 will be regulated in proper dependency on all relevant information.

The concentration of certain chemicals in the various baths is reduced in dependency on the density of individual images on the photosensitive material 13. In order to account for this, the monitoring circuit 21 receives from the regulating circuit 11 a bright/dark current which is the same or proportional to that serving to control the emission of radiation by the tube 10. The signal at the output of the monitoring circuit 21 is indicative of the brightness of tube 10, and such signal is transmitted to the corresponding input of the computer 20 as being representative of an additional parameter which must be considered in properly controlling the operation of the metering pump 6 and/or 8. In other words, the operation of the pumps 6 and 8 can be controlled as a function of a number of parameters including the dimensions of photosensitive material which is admitted into the developing machine, the optimum mode of development based on the composition of the emulsion and the type of carrier material for the emulsion, and the amounts of radiation issuing from the tube 10. This ensures that the concentration of various chemicals in the baths in sections 2*a* and 2*b* of the developing machine 2 is controlled and maintained within a desired range in dependency on the total area of emulsion entering the baths and also as a function of density of the admitted lengths of photosensitive material 13.

In lieu of direct transmission of signals from the regulating circuit 11 to the computer 20 via monitoring circuit 21, the apparatus of the present invention can be equipped with other suitable means for transmitting signals which are indicative of the amounts of radiation emitted by the tube 10. For example, a photocell can be provided to determine the brightness or intensity of radiation issuing from the tube 10 (or another suitable source of radiation) and to generate signals which are transmitted to the corresponding input of the computer 20.

Figure 2:
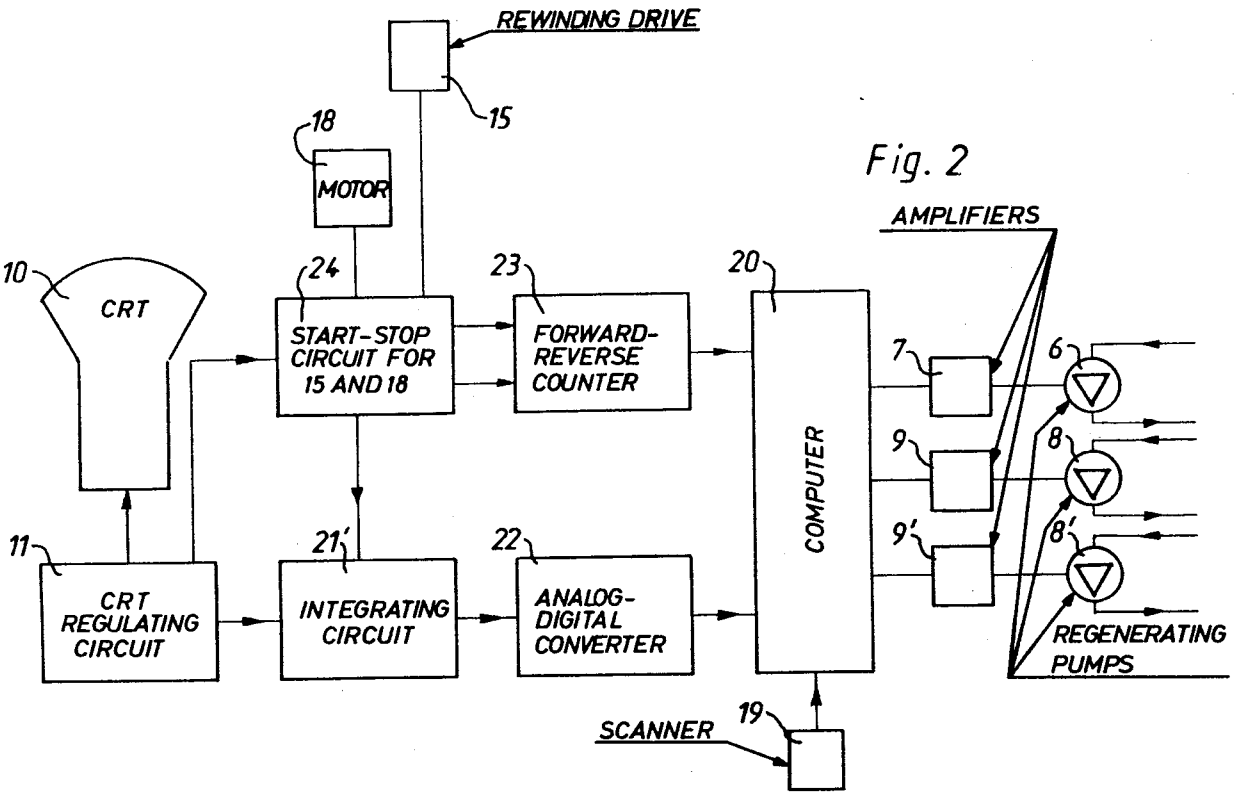
FIG. 2 is a diagrammatic view of a structure constituting a modification of that shown in FIG. 1.

FIG. 2 is a circuit diagram of a slightly different apparatus wherein the computer 20 has three outputs for transmission of appropriate signals to three discrete control units 7, 9, 9' which, in turn, transmit appropriate signals to three discrete adjustable regenerating means here shown as metering pumps 6, 8 and 8'. One input of the computer 20 receives signals from an integrating circuit 21' by way of an analog-digital converter circuit 22. The integrating circuit 21' receives signals from the aforementioned regulating circuit 11 of the exposing means (which further includes the tube 10) and from a start-stop unit 24 for the motor 18 and rewinding drive 15. The start-stop unit 24 further transmits signals to a forward-rearward counter 23 whose output is connected with a second input of the computer 20. A third input of the computer 20 is connected with the scanner 19. The intensity of signals which are periodically transmitted by the output of the integrating circuit 21' is indicative of the average radiation energy that is directed by the tube 10 upon photosensitive material 13 (not shown in FIG. 2). Since the characteristics of the photosensitive material are presumed to be known, the intensity of signals which are periodically transmitted to the analog-digital converter circuit 22 denote the average grey density of the exposed material. The computer 20 evaluates such signals, together with the signals from the scanner 19 and counter 23, and transmits appropriate signals to the control units 7, 9 and 9'.

The purpose of the signal generating device including the start-stop circuit 24 and the forward-reverse counter 23 is to account for the fact that, in many types of photocomposing work, the photosensitive material must be advanced forwardly and backwards. This necessitates the presence of the rewinding drive 15 which can draw photosensitive material back into the cassette 14. In the absence of any undertaking to the contrary, such rearward transport of photosensitive material would interfere with proper calculation of the area of emulsion which is admitted into the developing machine per unit of time. The forward-reverse counter 23 is designed to subtract the number of rearward steps of photosensitive material from the number of forward steps so that, on balance, the signal at the output of the counter 23 is indicative of the difference between forward and rearward transport of photosensitive material, i.e., of the length of photosensitive material which has been introduced into the developing machine per unit of time. The inputs of the counter 23 receive signals from the corresponding outputs of the start-stop circuit 24 which, as mentioned above, also transmits signals to the corresponding input of the integrating circuit 21'. The signals from the unit 24 to the integrating circuit 21' cause the circuit 21' to proceed with or to interrupt the integrating operation. The connection between the regulating circuit 11 and the unit 24 serves for transmission of signals to start the rewinding drive 15, i.e., such signals originate in the regulating circuit 11.

Each of the control units 7, 9, 9' can constitute or comprise an amplifier for signals which are transmitted by the corresponding outputs of the computer 20. The signals to the pumps 6, 8, 8' need not be identical, i.e., each of these pumps can be maintained in operation at different times and for different intervals. If the metering action of the pumps 6, 8 and 8' is identical, these pumps deliver different quantities of the respective fluids if they are kept in operation for different intervals of time. It is clear that these pumps constitute but one form of means for regenerating fluids in the respective vessels or compartments of the developing machine. For example, such pumps can be replaced by solenoid-operated valves which are installed in conduits connected to sources of pressurized fluid so that the length of the interval during which a valve remains open in response to a signal from the corresponding control unit (amplifier) determines the quantity of material which is admitted into the respective section of the developing machine. The sources of fresh or regenerated fluid are not shown in the drawing.

An important advantage of the improved apparatus is that it allows for accurate regeneration of one or more fluids on the basis of stored information (such as the extent to which the rate of admission of a fluid must be modified in view of certain characteristics of the photosensitive material) and on the basis of information which is readily available from components of the photocomposing machine 1 so that there is no need to install additional monitoring means, detectors, sensors or the like in the developing machine 2 for the purpose of monitoring the characteristics of various fluids in one or more sections containing fluids that require intermittent regeneration.

If no regeneration or very little regeneration takes place for extended periods of time, for example, because the photocomposing machine 1 is idle or because the amount of composition work is reduced to a minimum, the activator in the developing machine undergoes oxidation. To this end, the computer 20 can be set up to furnish a regenerating impulse of predetermined intensity in order to compensate for oxidation of the activator. The intensity and/or other characteristics of the regenerating impulse will or can depend on the nature of the selected developing and can take place when the quantity of advanced photosensitive material per unit of time has dropped below a preselected minimum value and/or when the length of the interval of idleness of the photocomposing machine has exceeded a predetermined value.

The advantage of the feature that the improved apparatus can dispense with monitoring devices in the developing machine 2 will be readily appreciated by referring to the disclosure of U.S. Pat. No. 3,787,689. This patent discloses a system which monitors the density of developed photosensitive material by causing the material to advance between a light source and a series of photocells. The photocells generate signals which are indicative of measured density of the photosensitive material. The accuracy of such apparatus is relatively low because the photocells determine the density of narrow strips of the exposed photosensitive material. If the material is to be monitored along the entire width, the monitoring system requires an inordinately large number of photocells with attendant problems as regards the establishment of clear-cut boundaries between the measuring ranges of neighboring photocells. On the other hand, the improved apparatus is designed to dispense with any monitoring of the exposed photosensitive material and to use, instead, signals which are generated and/or readily available in the photocomposing machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for processing a web of photosensitive material, comprising a photocomposing machine having means for exposing photosensitive material; a developing machine arranged to develop the exposed material and including at least one bath containing a supply of fluid which contacts the exposed photosensitive material and whose characteristics change as a result of such contact with the exposed photosensitive material; adjustable regenerating means for the fluid of said bath; and means for adjusting said regenerating means as a function of the characteristics of undeveloped photosensitive material and as a function of the operation of the photocomposing machine.

2. The apparatus of claim 1, wherein said adjusting means includes means for adjusting said regenerating means exclusively as a function of the characteristics of undeveloped photosensitive material and as a function of the operation of the photocomposing machine.

3. The apparatus of claim 1, wherein said exposing means comprises radiation emitting means for composing information on the photosensitive material, said adjusting means including means for monitoring the amounts of radiation which is emitted by said radiation emitting means and control means for adjusting said regenerating means as a function of monitored amounts of radiation.

4. The apparatus of claim 3, wherein said monitoring means is arranged to generate signals denoting the overall density of exposed photosensitive material.

5. The apparatus of claim 3, wherein said exposing means further comprises means for generating signals denoting the intensity of emitted radiation and said monitoring means includes means for integrating said signals, said control means being arranged to adjust said regenerating means as a function of said integrated signals.

6. The apparatus of claim 5, wherein said adjusting means further comprises an evaluating device having a first input for said integrated signals, at least one second input and an output connected with said control means, and further comprising signal generating scanning means for transmitting to said second input signals denoting at least one characteristic of photosensitive material in said photocomposing machine, said evaluating device being arranged to transmit to said control means signals which are a function of signals at said first and second inputs.

7. The apparatus of claim 6, wherein said scanning means includes means for monitoring the rate of introduction of photosensitive material from said photocomposing machine into said developing machine.

8. The apparatus of claim 6, wherein said scanning means comprises means for monitoring the dimensions of photosensitive material in said photocomposing machine.

9. The apparatus of claim 3, wherein said radiation emitting means includes a source of radiation and said exposing means further comprises means for regulating the rate of emission of radiation from said source, said regulating means being arranged to generate signals denoting the amounts of radiation which is emitted by said source and said monitoring means including means for integrating said signals.

10. The apparatus of claim 9, wherein said adjusting means further comprises a signal evaluating circuit having an input and an output which latter is connected with said control means, and an analog-digital converter circuit interposed between said integrating means and the input of said evaluating circuit.

11. The apparatus of claim 3, wherein said photocomposing machine further comprises means for scanning the characteristics of photosensitive material, means for transporting the photosensitive material forwardly and backwards, and a device for generating signals denoting the quantity of material which is introduced into the developing machine per unit of time, said adjusting means further including an evaluating circuit having a first input connected with said scanning means, a second input connected with said signal generating device, and an output connected with said control means and arranged to transmit signals which are a function of signals transmitted to said inputs.

12. The apparatus of claim 11, wherein said device includes a forward-reverse counter.

13. The apparatus of claim 11, wherein said device includes means for transmitting signals denoting interruptions of advancement of photosensitive material from said photocomposing to said developing machine and said control means is arranged to transmit to said regenerating means regenerating impulses in response to signals denoting interruptions of advancement of photosensitive material for preselected periods of time.

* * * * *